US007832575B2

(12) United States Patent
Krome

(10) Patent No.: US 7,832,575 B2
(45) Date of Patent: Nov. 16, 2010

(54) ARTICULATED JOINT COUPLING

(75) Inventor: Andreas Krome, Oberreichenbach (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 12/224,936

(22) PCT Filed: Feb. 28, 2007

(86) PCT No.: PCT/EP2007/051875

§ 371 (c)(1),
(2), (4) Date: Oct. 9, 2008

(87) PCT Pub. No.: WO2007/104643

PCT Pub. Date: Sep. 20, 2007

(65) Prior Publication Data

US 2009/0101615 A1 Apr. 23, 2009

(30) Foreign Application Priority Data

Mar. 11, 2006 (DE) ..... 10 2006 011 425

(51) Int. Cl.
*B61G 1/28* (2006.01)

(52) U.S. Cl. ..... 213/75 R

(58) Field of Classification Search ..... 213/75 R, 213/85, 182–184, 188, 192; 105/4.1, 4.2
See application file for complete search history.

(56) References Cited

U.S. PATENT DOCUMENTS 5,172,819 A * 12/1992 Daugherety et al. ..... 213/75 R
5,219,082 A * 6/1993 Daugherty et al. ..... 213/75 R

FOREIGN PATENT DOCUMENTS

CH 687099 * 9/1993
DE 10360289 * 7/2001

* cited by examiner

*Primary Examiner*—S. Joseph Morano
*Assistant Examiner*—Zachary Kuhfuss
(74) *Attorney, Agent, or Firm*—Charles A. Muserlian

(57) ABSTRACT

An articulated joint coupling (1) for rail vehicles comprises a coupling lug (3), which engages into a coupling fork (4), and a spherical bearing (2) in the coupling lug (3), with the spherical bearing (2) having an inner ring (5) with a convex surface (6) which is pivotably mounted in an outer ring (7) with a concave surface (8), and with the outer ring (7) being fastened in an opening (14) of the coupling lug (3). To fasten the outer ring (7) in the opening (14) of the coupling lug (3), both the outer ring (7) and also the coupling lug (3) have in each case one groove (15, 17), with a clamping ring (18) lying in the groove (17) of the outer ring (7) and simultaneously in the groove (15) of the coupling lug (3).

8 Claims, 3 Drawing Sheets

ARTICULATED JOINT COUPLING

This application is a 371 of PCT/EP2007/051875 filed Feb. 28, 2007

FIELD OF THE INVENTION

The invention relates to an articulated joint coupling for rail vehicles, in which a coupling lug is mounted by means of a spherical bearing in a coupling fork.

BACKGROUND OF THE INVENTION

An articulated coupling joint of the type specified in the introduction is known for example from U.S. Pat. No. 5,172,819 A. Said articulated coupling joint is a coupling for the semi-permanent connection of wagons. Units of, for example, ten wagons are assembled, with said units generally being separated only for servicing purposes. The semi-permanent connection between the wagons is intended to contribute to a reduction in the effects of impact forces which act on a wagon under the jolting conditions of train operation.

OBJECT OF THE INVENTION

The object on which the invention is based is that of specifying an articulated joint coupling which is suitable for rail vehicles and which is characterized both by a construction which meets the demands and also by particularly economical production.

SUMMARY OF THE INVENTION

Said object is achieved according to the invention by means of an articulated joint coupling having the features of claim 1. Said articulated joint coupling has a coupling lug which engages into a coupling fork and which has a spherical bearing, wherein the coupling fork and the coupling lug can also be referred to as a female part and male part respectively. Parts of the spherical bearing are an inner ring with a convex surface and an outer ring, which interacts with said inner ring and forms a plain bearing, with a concave surface which is fastened in an opening of the coupling lug. To fasten the outer ring in the typically circular opening of the coupling lug, both the outer ring and also the coupling lug have in each case one groove, with a clamping ring lying in the groove of the outer ring and simultaneously in the groove of the coupling lug. In general, the clamping ring, as a single-piece metal part, is axially slotted; it is alternatively possible to use a plurality of individual clamping ring segments.

The fastening of the outer ring in the coupling lug by means of a clamping ring firstly has the advantage of simple assembly; secondly, on account of the omission of welding operations, there are no restrictions with regard to materials. In particular, it is possible to use a split outer ring. A small width of the clamping ring in relation to the outer ring and also in relation to the coupling lug permits large-area contact of the outer ring in the opening of the coupling lug, and therefore a particularly uniform introduction of force. The width of the clamping ring as measured in the axial direction is preferably less than 15%, in particular less than 10%, of the width of the outer ring measured in the same direction. The latter width preferably corresponds to the width of the coupling lug.

In one preferred embodiment, the coupling lug has bores which extend from the periphery of the coupling lug to the groove of the coupling lug. Said bores serve to receive screws, by means of which the radial positioning of the clamping ring can be altered at least in sections. This may involve either an increase or else a decrease in the radius of the clamping ring. While having the largest radius possible, the clamping ring which forms a part of the articulated joint coupling is preferably situated entirely in the groove of the coupling lug. The clamping ring is advantageously elastically pre-loaded in such a way that, for as long as it is not acted on by any further forces, it is situated entirely in the groove of the coupling lug. With the clamping ring in said position, it is possible in a very simple manner for the outer ring to be inserted into the opening of the coupling lug. In order to subsequently connect the clamping ring in a form-fitting manner to the outer ring, it is necessary merely for the screws which are situated in the bores to be tightened, which screws hereby exert a radially inward force on the clamping ring.

During the disassembly of the articulated joint coupling, it may in a similar way be sufficient to release said screws in order that the clamping ring expands and permits a separation of the outer ring and coupling lug. Should the clamping ring become stuck in the groove of the outer ring, for example as a result of corrosive effects, it is advantageously made possible to pull the clamping ring outward, into the groove of the coupling lug, by means of a plurality of screws.

In one modification of the above-described arrangement of the screws, which are provided for moving and/or securing the clamping ring, it is also possible to provide an end-side screw connection of the clamping ring. The advantage of a screw connection of said type having screws which are arranged parallel to the axial direction of the clamping ring and of the outer and inner rings may, depending on the geometric conditions, in individual cases be in particular a favorable stress distribution, with the position of a neutral fiber being utilized. A combination of a radial and axial arrangement of clamping screws which act directly or indirectly on the clamping ring is also possible.

The screws which are provided for pressing the clamping ring into the groove of the outer ring may be prevented from turning loose by means of adhesive bonding, for example. In addition to or instead of adhesive bonding, a clip composed of steel is placed around the openings in the coupling lug as a measure for preventing the screws from turning loose, wherein a fastening can be provided on one side or symmetrically on both sides.

In one advantageous embodiment, the clamping ring has, in cross section, a radially inwardly aligned, at least single-sided tapered portion. The tapered portion is preferably formed so as to be double-sided, symmetrically with respect to a plane which intersects the clamping ring and if appropriate the radial bores. The groove in the outer ring has a radially inwardly tapering cross section which is matched to the cross section of the clamping ring, such that the clamping ring can be positioned without play in the outer ring. In contrast, when the articulated joint coupling is fully assembled, the play of the clamping ring in the groove of the coupling lug is preferably maintained.

According to one preferred refinement, two clamping rings which are arranged in parallel planes are positioned between the outer ring and the coupling lug. Aside from the grooves which receive the clamping rings, the outer surface of the outer ring and the surface of the opening of the coupling lug may be of continuous cylindrical design. Here, the axial fixing of the outer ring relative to the coupling lug takes place exclusively by means of the clamping rings. Deviating from said embodiment, it is also possible for a flange to be formed on the coupling lug and/or on the outer ring. In this case, preferably only a single clamping ring is inserted between the coupling lug and the outer ring. The flange of the coupling lug or of the outer ring preferably has a chamfered flange which abuts against the in each case other component. The end side of the flange which is integrally formed on one of the components, in particular on the outer ring, is preferably aligned with the end-side surface of the other components, in particular of the coupling lug.

A plurality of exemplary embodiments of the invention are explained in more detail on the basis of a drawing, in which:

DETAILED DESCRIPTION OF THE DRAWINGS

Corresponding or equivalent parts are denoted by the same reference symbols in all figures.

Figure 1:
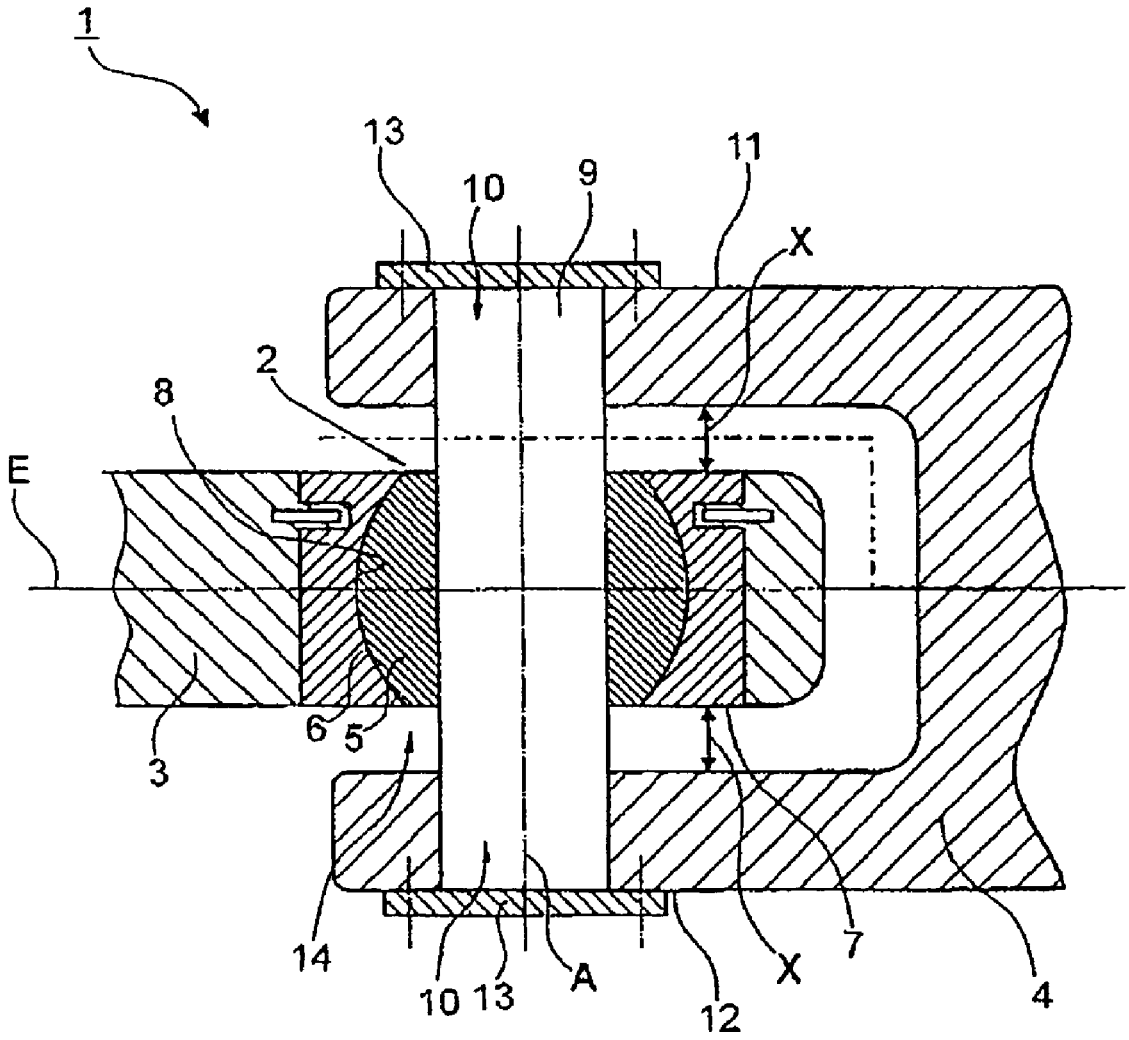
FIG. 1 shows, in cross section, a first exemplary embodiment of an articulated joint coupling for rail vehicles.

FIG. 1 illustrates, in simplified form, an articulated joint coupling 1 for rail vehicles, the basic function of which is known for example from DE 103 60 289 A1. The articulated joint coupling 1 is likewise suitable for example for couplings with tension rods, as described in DE 195 43 183 A1. A further application for the articulated joint coupling 1 is in the coupling of ends, which are supported on a common bogie, of two vehicle units which are articulatedly connected to one another, as basically described in EP 0 520 301 A1.

The articulated joint coupling 1 has a spherical bearing 2, by means of which a coupling lug 3 is connected to a coupling fork 4. A degree of play of the articulated joint coupling 1 in a first direction is denoted by x; there is also a degree of play in a direction orthogonal with respect thereto. Depending on the installation position of the articulated joint coupling 1, the play x may be the vertical play or the horizontal play.

The bearing 2 is embodied as a plain bearing, with an inner ring 5 being pivotably mounted with a spherical surface 6 in an outer ring 7 with a concave surface 8. A pin 9 extends through the inner ring 5, which pin 9 is held in bores 10 situated in fork cheeks 11, 12 of the coupling fork 4. To prevent movement of the pin 9, the bores 10 are covered by closure flaps 13.

Before the assembly of the articulated joint coupling 1, the outer ring 7 is split by forces acting in the radial direction. This has the advantage that the outer ring 7 need not be divided along a plane E which forms a plane of symmetry of the spherical bearing 2, which plane of symmetry is arranged normally with respect to the axis of symmetry A of said bearing 2. The outer ring 7, which is constructed as a split outer ring, is inserted into a cylindrical opening 14 of the coupling lug 3. Details of the fastening of the outer ring 7 in the opening 14 of the coupling lug 3 can be clearly seen in particular from FIGS. 2 and 3, which show exemplary embodiments of articulated joint couplings 1 whose basic design corresponds to the exemplary embodiment as per FIG. 1.

The following explanations refer, unless stated otherwise, to all of the illustrated exemplary embodiments. A groove 17 on the outer, substantially cylindrical surface 16 of the outer ring 7 is situated opposite a groove 15 in the wall 18 of the opening 14. The corresponding width b, measured in the axial direction, of the grooves 15, 17 is approximately 10% of the width B of the coupling lug 3 and of the outer ring 7. In the illustrated fully assembled state of the articulated joint coupling 1, a clamping ring 18 engages into the two grooves 15, 17 and thereby forms a connection between the outer ring 7 and the coupling lug 3. Before the outer ring 7 is inserted into the opening 14 of the coupling lug 3, the clamping ring 18 is, on account of its elastic preload, situated entirely within the groove 15 of the coupling lug 3.

In a way which is not shown in the figures, the clamping ring 18 is axially slotted, such that the diameter of the clamping ring 18 can be varied by means of forces which act on it. If, during the assembly of the articulated joint coupling 1, the outer ring 7 is situated in the final (illustrated) position relative to the coupling lug 3, then the diameter of the clamping ring 18 is reduced by means of individual screws 19 which extend in each case through a bore 20, which is arranged in the radial direction, in the coupling lug 3, such that the clamping ring 18 engages partially into the groove 17 of the outer ring 7. The screws 19 are prevented from turning loose by means of a steel clip 21. The bore 20 which extends through the coupling lug 3 is formed as a threaded bore 22 which has a diameter which is slightly smaller than the constant width b of the groove 15 of the coupling lug 3. In contrast, the groove 17 of the outer ring 7 has a radially inwardly conically running, single-sided (FIG. 3) or double-sided (FIG. 2) shape, which is matched to a tapering portion 23 of the clamping ring 18. The clamping ring 18 is thereby braced in the groove 17 without play.

Figure 2:
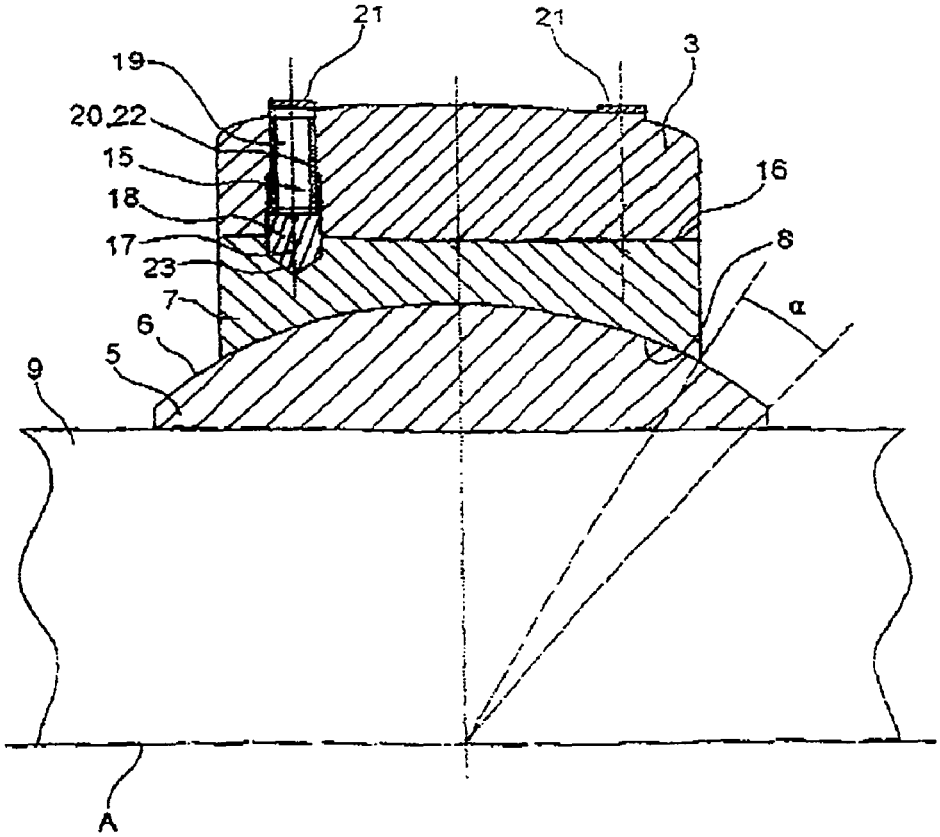
FIG. 2 shows, in cross section, a second exemplary embodiment of an articulated joint coupling for rail vehicles.
Figure 3:
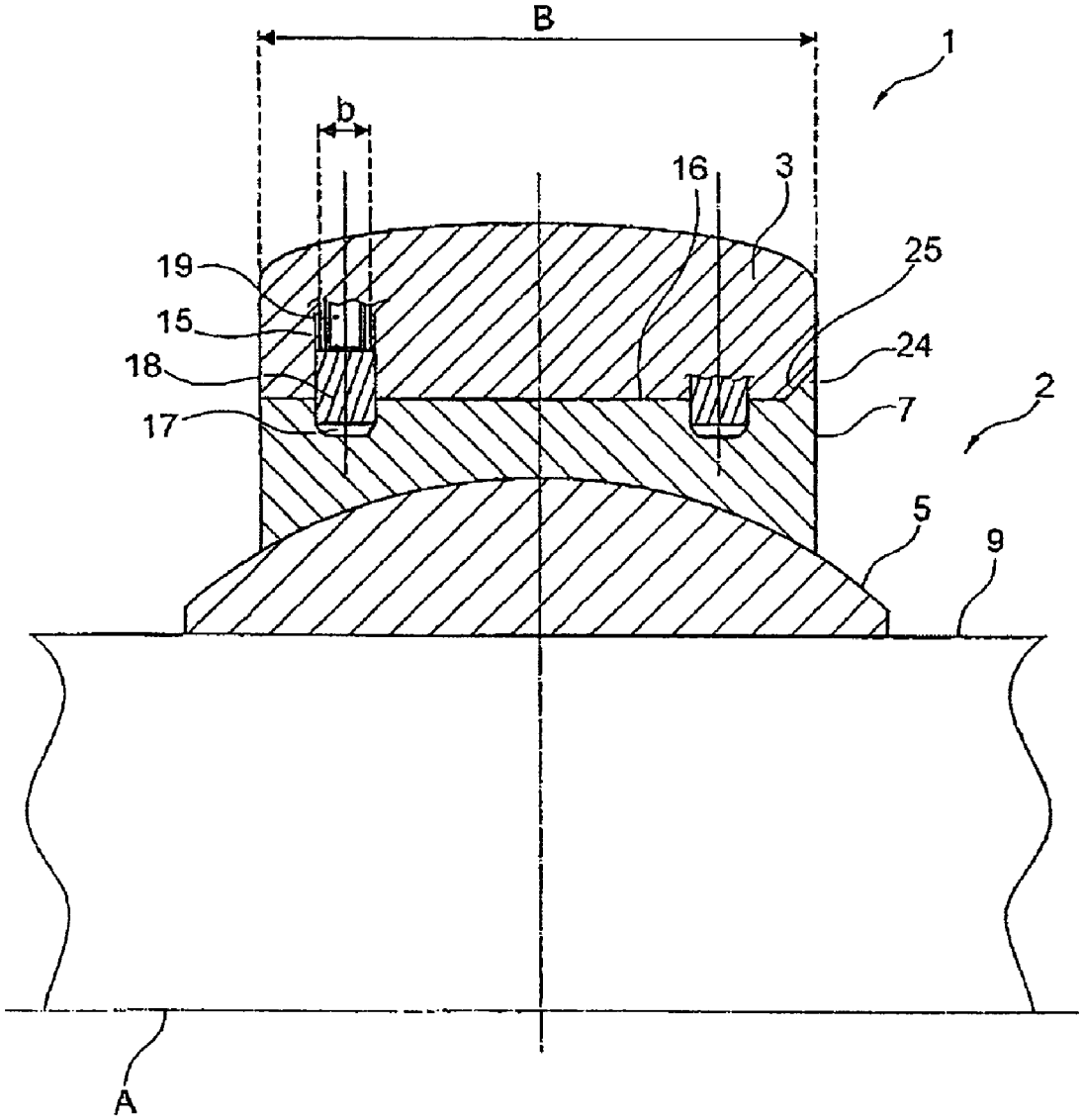
FIG. 3 shows, in a view similar to FIG. 2, a third exemplary embodiment of an articulated joint coupling for rail vehicles.

With the shape, which is chamfered at both sides, of the clamping ring 18 as per FIG. 2, a single clamping ring 18 is sufficient, while in the case of only single-sided chamfering of the clamping ring as per FIG. 3, preferably two clamping rings 18 are braced between the coupling lug 3 and the outer ring 7. In particular in cases in which only a single clamping ring 18 with single-sided chamfering is provided, it is advantageous if a flange 24 is integrally formed on the outer ring 7, as can be seen in FIG. 3. Said flange 24 has a chamfered flank 25 which bears against the coupling lug 3. In all the exemplary embodiments, the outer ring 7 and the coupling lug 3 have a corresponding width B regardless of a flange 24 which may be provided and which may alternatively also be integrally formed on the coupling lug 3. A pivot angle of the pin 9 relative to the outer ring 7 is denoted by $\alpha$.

The invention claimed is:

1. An articulated joint coupling for rail vehicles, having a coupling lug which engages into a coupling fork and having a spherical bearing in the coupling lug, with the spherical bearing having an inner ring with a convex surface which is pivotably mounted in an outer ring with a concave surface, and with the outer ring being fastened in an opening of the coupling lug, wherein, to fasten the outer ring in the opening of the coupling lug, both the outer ring and also the coupling lug have in each case one groove, with a clamping ring lying in the groove of the outer ring and simultaneously in the groove of the coupling lug the coupling lug has bores which connect the periphery of the coupling lug to the groove and a screw which is arranged in the bore and which is provided for exerting a force on the clamping ring in the radial direction.

2. The articulated joint coupling of claim 1, wherein a clip covers the bores.

3. The articulated joint coupling of claim 1, wherein the clamping ring has an elastic preload which is such that said clamping ring is arranged entirely within the groove of the coupling lug without any further mechanical loading.

4. The articulated joint coupling of claim 1, wherein the clamping ring has a radially inwardly aligned tapered portion.

5. The articulated joint coupling of claim 1, wherein the clamping ring is arranged without play in the groove of the outer ring and simultaneously with play in the groove of the coupling lug.

6. The articulated joint coupling of claim 1, wherein the outer ring has a flange which abuts against the coupling lug.

7. The articulated joint coupling of claim 6, wherein the flange has a chamfered flank which bears against the coupling lug.

8. The articulated joint coupling of claim 1, wherein two clamping rings which engage in each case into a groove of the outer ring and into a groove of the coupling lug.

* * * * *